United States Patent [19]

Faasse

[11] Patent Number: 4,913,193

[45] Date of Patent: Apr. 3, 1990

[54] LIGHT WEIGHT HEDDLE SUPPORT BAR

[75] Inventor: Gene E. Faasse, Greer, S.C.

[73] Assignee: Steel Heddle Mfg. Co., Greenville, S.C.

[21] Appl. No.: 310,762

[22] Filed: Feb. 14, 1989

[51] Int. Cl.[4] ..... D03C 9/04

[52] U.S. Cl. ..... 139/91

[58] Field of Search ..... 139/91, 92

[56] References Cited

U.S. PATENT DOCUMENTS

| | | | |
|---|---|---|---|
| 3,754,577 | 8/1973 | Heller | 139/92 |
| 3,901,282 | 8/1975 | Kramer | 139/92 |
| 4,106,529 | 8/1978 | Kaufmann | 139/92 |
| 4,633,916 | 1/1987 | Rast | 139/92 |
| 4,790,357 | 12/1988 | Kramer | 139/91 |

*Primary Examiner*—Henry S. Jaudon

*Attorney, Agent, or Firm*—Dority & Manning

[57] ABSTRACT

A heddle bar having a cross-sectional profile for supporting heddles in a heddle frame. The heddle bar has a supporting rib for engaging a heddle bar support channel in each of the slats making up the heddle frame assembly in an interference fit therewith to make its removal difficult but not impossible. The heddle support bar is not bonded or glued to the slat.

The heddle bar may be shaped to support any type heddle, and may be T-shaped or shaped to support J-shaped heddles.

7 Claims, 3 Drawing Sheets

LIGHT WEIGHT HEDDLE SUPPORT BAR

BACKGROUND OF THE INVENTION

This invention relates to a light weight extruded heddle support bar for use in a heddle frame assembly on a loom. The heddle support bar of the invention is utilized in connection with the heddle frame assembly on a loom to provide supporting surfaces for supporting heddles within the frame. The heddle frame includes a top frame slat and a bottom frame slat which are spaced apart in the frame by a pair of side frame members. Heddle bars are provided for each of the frame slats, that is, the upper and the lower frame slats for supporting heddles within the frame assembly. The heddles include eyes through which warp threads are threaded.

In the loom, the heddle frame raises and lowers the warp ends to create a shed through which the warp yarn is inserted during weaving. In lifting the warp threads during the shedding motion the heddle frame undergoes forces in a vertical direction while moving the warp ends to form a shed. This produces a bending moment on the frame slat and also the heddle bar.

As the speeds at which the looms are driven increases the inertia loading on the heddle frames and the heddle bars during shedding is greatly increased. Since the inertia forces are dependent upon the mass of the heddle frame assembly, there has been a great need to provide light weight frame members for the heddle frame assembly without sacrificing structural integrity. As noted, during the shedding motion the shedding frame assembly reciprocates vertically in rapid strokes which increase as the operating speeds of the loom increase. Therefore, the provision of a light weight component for the heddle bar is a problem to which considerable attention need be given.

Considerable progress has been made in this area as represented by the disclosure in U.S. Pat. No. 4,633,916 issued Jan. 6, 1987 to John L. Rast, commonly owned by the assignee of the instant application. This patent discloses a light weight shed resistant frame slat with means for supporting a heddle bar at one edge. In the slat disclosed in this patent, two ledges form a mounting slot for the heddle bar. The heddle bar in this patent is a carbon fiber pultrusion which is affixed in the mounting slot by means of an epoxy glue or the like. Since the heddle bar is bonded in the supporting slot it is very difficult, if not impossible, to replace the heddle bar when it becomes damaged or worn.

SUMMARY OF THE INVENTION

Accordingly, an important object of the present invention is to provide a heddle bar for a heddle frame assembly slat which is light in weight and in which the heddle bar is readily replaceable in the slat. Still another object of the invention is to provide a heddle support bar which is adapted to be held securely in the slat while still permitting its removal therefrom.

Still another important object of the invention is to provide an extruded heddle support bar having a T-shaped cross-section which has been oriented to precise dimensions for engaging the supporting slot in the slat.

The above objects are accomplished according to the present invention by providing a heddle bar which is extruded from a thermoplastic material and oriented to precise dimensions. The heddle bar of the invention has spaced heddle supporting surfaces and a heddle bar support rib intermediate the surfaces which is sized to fit within the mounting slot of the frame slat in an interference fit. The support channel in each of the slats is defined by spaced upper and lower ledges which extend from the heddle bar support portion in generally horizontal planes. Each of the ledges have a locking ridge disposed on their adjacent surfaces for gripping and holding the mounting rib of the heddle bar. The dimensions of the heddle bar rib and the heddle bar support or slot channel are selected so as to provide an interference fit between the inner walls of the channel and the outer walls of the heddle bar rib. This permits the heddle bar to be readily attached to the slat in which it is held securely during use by the locking ridges of the channel walls. The ridges on the inner walls of the channel make it difficult to remove the heddle bar but still permits its removal when such removal becomes necessary. This prevents its accidental removal from the channel during use of the frame assembly on the loom.

BRIEF DESCRIPTION OF THE DRAWINGS

A construction designed to carry out the invention will be hereinafter described, together with other features thereof. The invention will be more readily understood from a reading of the following specification, and by reference to the accompanying drawings, forming a part thereof, wherein an example of the invention is shown, and wherein.

DETAILED DESCRIPTION OF THE DRAWINGS

Figure 1:
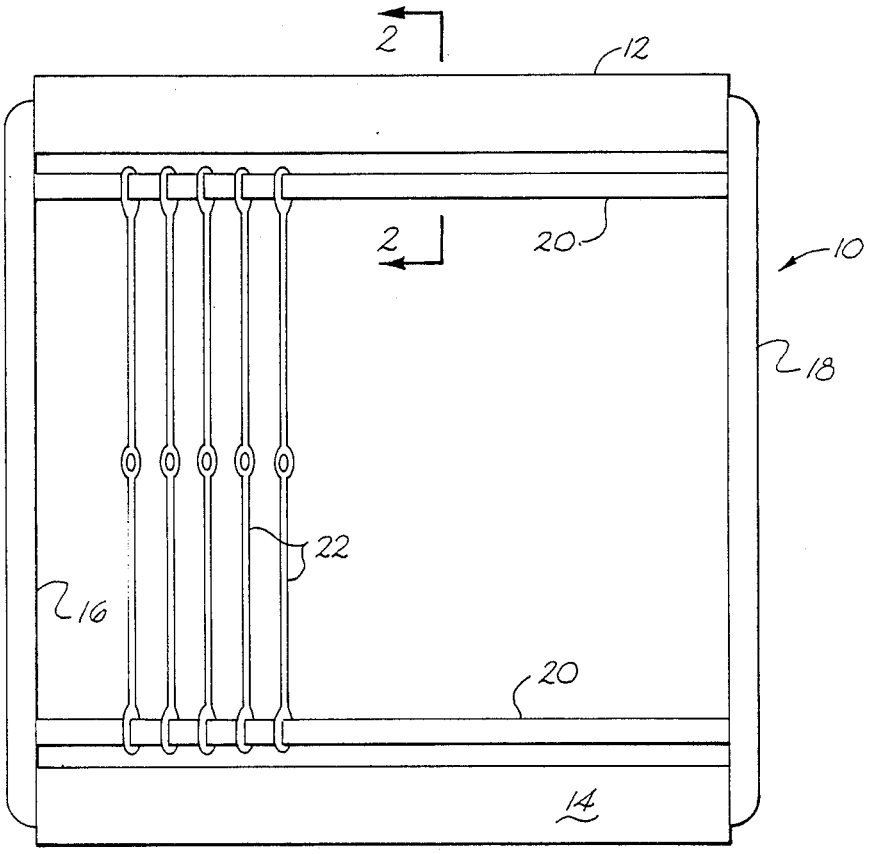
FIG. 1 is an elevational front view illustrating the heddle frame assembly of a loom, having frame slats and heddle bars constructed in accordance with the present invention.

The invention relates to an extruded heddle bar for use in a heddle frame assembly on a loom where it holds the warp ends and raises and lowers the warp ends during the shedding motion. Since the structural and operational features of looms are well known the loom will not be illustrated and only so much of the heddle frame assembly as is necessary for an understanding of the present invention is shown in the drawings.

Referring now to FIG. 1 of the drawings, wherein the heddle frame assembly is illustrated. Heddle frame assembly 10 comprises a top slat 12 and a bottom slat 14, which are supported in the horizontal plane by side frame members 16 and 18 in parallel relationship to each other. Each of the slats supports a heddle support bar 20 which in turn supports a plurality of warp heddles 22.

Figure 2:
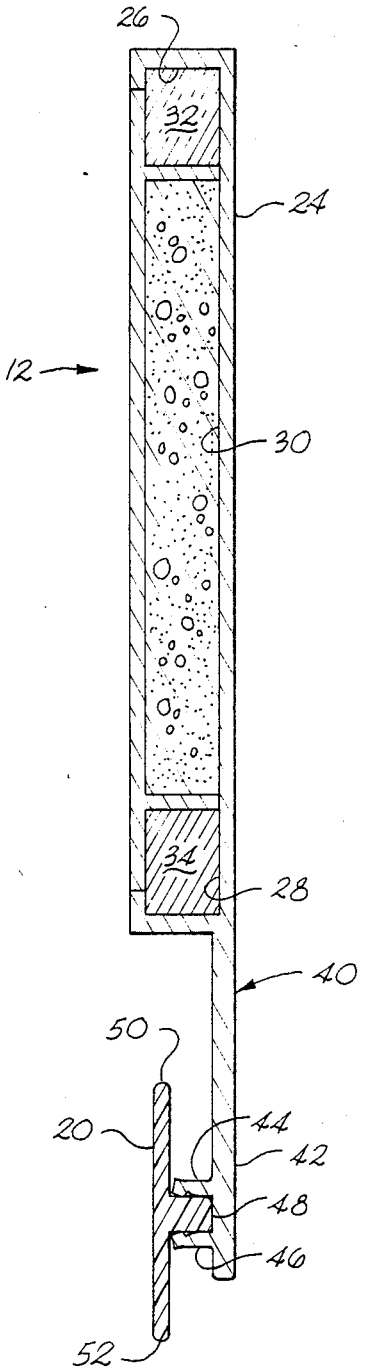
FIG. 2 is a sectional view taken along line 2—2 of FIG. 1.
Figures 3, 4, 5:
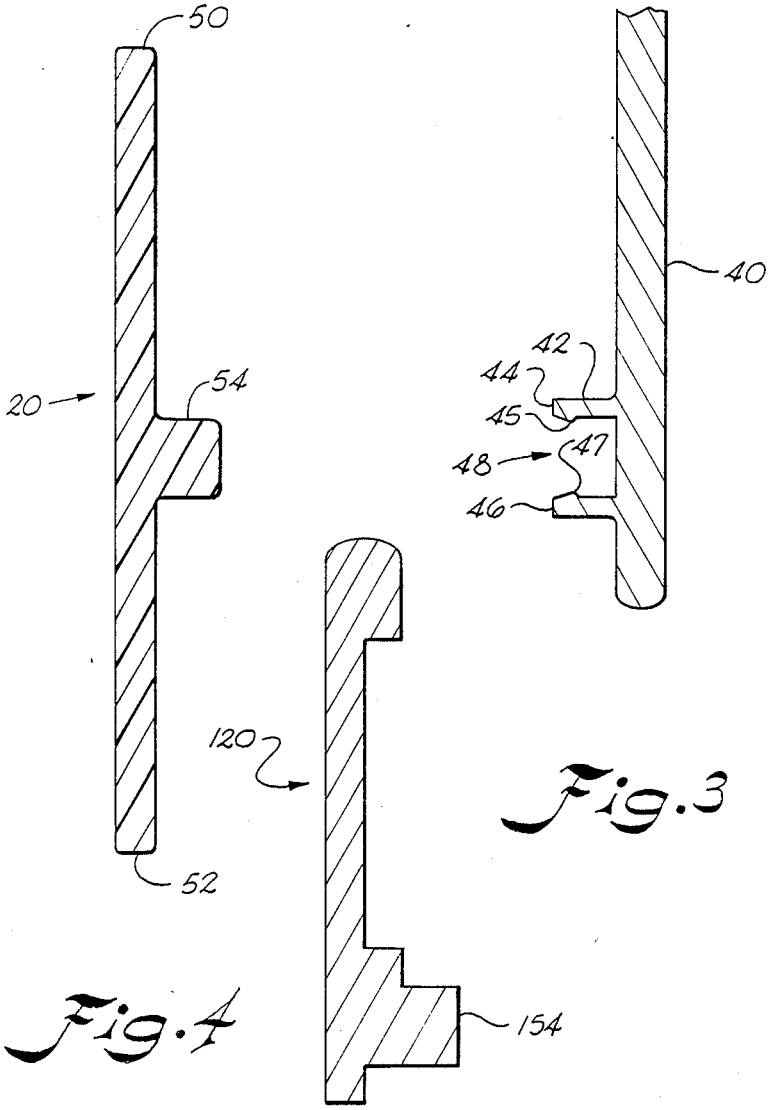
FIG. 3 is an enlarged cross-sectional view of the heddle bar support channel of the invention.
FIG. 4 is a cross-sectional view of the heddle bar of the invention, taken along line 4—4 of FIG. 1.
FIG. 5 is a cross-sectional view similar to that of FIG. 4 but showing an alternative heddle bar which may be utilized with the heddle bar support channel illustrated in FIG. 3.

Referring now to FIGS. 2 and 3 of the drawing wherein slat 12 is illustrated in detail. It will be understood that while only slat 12 is illustrated in detail, each of the slats 12 and 14 is identical with only different orientation within the heddle frame assembly. Each of the slats comprises an upper slat portion 24 which is hollow and has an upper cavity 26, a lower cavity 28, and a center cavity 30 therein. An upper reinforcing bar 32 is disposed within upper cavity 26 and a lower reinforcing bar 34 is disposed within lower cavity 28 for providing rigidity and strength to upper slat portion 24. In addition to the reinforcing bars, center cavity 30 is filled with a rigid foam material, again for adding rigidity to the upper slat portion.

Slat 12 also has a heddle bar support portion 40 which is integral with, and depends from, upper slat portion 24. Support portion 40 comprises a vertically extending support member 42 which, in turn, has two horizontal ledges, upper ledge 44 and lower ledge 46, extending in a horizontal plane from one surface of the vertically extending support member 42. A heddle bar support channel or slot 48 is provided by the inside surfaces of upper ledge 44 and lower ledge 46. As best seen in FIG. 3, ledges 44 and 46 are provided with locking ridges 45 and 47 on their adjacent edges for admitting and locking a heddle support bar in place within channel 48.

Details of the structure of the slat itself are provided in a U.S. patent application Ser. No. 07/273,276, filed at the same time as this application was filed for Light Weight Heddle Frame Assembly Slat in the name of Charles F. Kramer, and assigned to the assignee of this application.

Referring now to FIG. 4, wherein is illustrated the heddle bar of the invention. Heddle bar 20 is extruded in a T-shaped profile from ultrahigh molecular weight polyethylene. This material provides the necessary structural strength and rigidity for supporting the heddles on the heddle frame assembly while at the same time being light weight and easy to assembly.

Heddle bar 20 comprises an upper heddle support surface 50 and a lower heddle support surface 52 about which the heddles extend for guiding the warp ends in reciprocating vertical motion on the heddle frame assembly. Intermediate surfaces 50 and 52 is a heddle bar support rib 54 which is provided with dimensions to enable it to fit within channel 48 in an interference fit with locking ridges 45 and 47 to securely retain and support the heddle support bar, making it difficult to remove the heddle support bar but not impossible, since it is sometimes necessary to replace heddle bars because of damage or wear thereon from contact with heddles 22.

Referring now to FIG. 5 of the drawings, wherein is illustrated an alternative heddle bar 120 which is adapted to support J-shaped heddles and to be supported by slat 12 as was the case with the T-shaped profile heddle bar 20 illustrated in FIG. 4. Heddle bar 120 may also be extruded with the cross-sectional shape illustrated in FIG. 5 from ultra high molecular weight polyethylene.

Heddle bar 120 comprises an upper heddle support surface 150 which is rounded to receive the J-shaped heddles. At the lower end of the heddle bar 120 is the heddle bar support rib 154 which is provided with dimensions to enable it to fit within channel 48 in an interference fit with locking ridges 45 and 47, which securely retain and support the heddle support bar, making it difficult to remove the heddle support bar but not impossible, since it is sometimes necessary to replace heddle bars because of damage or wear thereon from contact with the heddles.

While two heddle bar shapes have been shown and described hereinabove for use with the supporting slat, it is obvious that various other shapes can be utilized without departure from the spirit or scope of applicant's claims.

We claim:

1. In a heddle frame assembly for a loom, said frame having upper and lower frame slats vertically spaced from each other by side frame members to form a generally rectangular frame, each of said slats having a heddle bar support portion and two ledges thereon which define a heddle rod support channel with locking ridges disposed on the inner walls of each of said ledges for engaging and holding a heddle bar, wherein said heddle bar comprises:

(a) a generally T-shaped profile extruded from a thermoplastic light weight material, shaped to predetermined dimensions;

(b) an upper heddle supporting surface on said profile for retaining and supporting heddles in said frame;

(c) a lower heddle supporting surface on said profile, spaced from said upper heddle supporting surface, for retaining and supporting said heddles in said frame;

(d) a heddle bar supporting rib disposed between said upper and said lower heddle supporting surfaces having a thickness for releasably engaging the inner walls of said support channel in an interference fit with said lock ridges for holding said heddle bar securely therein while permitting its removal therefrom; and (e) said heddle bar being extruded from ultra-high molecular weight polyethylene.

2. A heddle bar as set forth in claim 1, wherein said lower and said upper heddle supporting surfaces are disposed on the edges of a vertically extending portion of said profile.

3. A heddle bar as set forth in claim 2, wherein said heddle bar supporting rib extends horizontally from said vertically extending portion of said profile at a point intermediate said upper and said lower heddle supporting surfaces.

4. In a heddle frame assembly for a loom, said frame having upper and lower frame slats vertically spaced from each other by side frame members to form a generally rectangular frame, each of said slats having a heddle bar support portion and two ledges thereon which define a heddle support channel with locking ridges disposed on the inner walls of said ledges for engaging and holding a heddle bar, wherein said heddle bar comprises:

(a) a profile adapted to support heddles, extruded from a thermo-plastic, lightweight material, shaped to predetermined dimensions;

(b) an upper heddle supporting surface on said profile for retaining and supporting heddles in said frame;

(c) a heddle bar supporting rib disposed on said profile spaced from said heddle supporting surface having a thickness for relatively engaging the inner walls of said support channel in an interference fit for holding said heddle bar securely therein while permitting its removal therefrom; and (d) said heddle bar being extruded from ultra-high molecular weight polyethylene.

5. A heddle bar as set forth in claim 4, wherein said heddle bar supporting rib extends horizontally from said vertically extending portion of said profile.

6. A heddle bar as set forth in claim 4, wherein said heddle bar has a T-shaped profile.

7. A heddle bar as set forth in claim 4, wherein said profile is shaped to receive and support J-shaped heddles.

* * * * *